US006904620B2

(12) United States Patent
Nishimoto

(10) Patent No.: US 6,904,620 B2
(45) **Date of Patent: *Jun. 14, 2005**

(54) PROTECTOR

(75) Inventor: Fumitoshi Nishimoto, Sakai (JP)

(73) Assignee: Futago Shoji Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/358,206

(22) Filed: Feb. 5, 2003

(65) Prior Publication Data

US 2004/0003456 A1 Jan. 8, 2004

(30) Foreign Application Priority Data

Feb. 7, 2002 (JP) ..... 2002-030754
Feb. 8, 2002 (JP) ..... 2002-032892
Oct. 1, 2002 (JP) ..... 2002-288649

(51) Int. Cl.[7] ..... A41D 13/00
(52) U.S. Cl. ..... 2/463
(58) Field of Search ..... 2/463, 44, 92, 2/22, 23, 24, 69, 62, 269, 911, 464–467, 2.5, 468, 462, 913; 128/878, 881, 882; 602/5, 16, 20, 23, 26, 62

(56) References Cited

U.S. PATENT DOCUMENTS 3,125,762 A * 3/1964 Glahe ..... 2/463
3,772,704 A * 11/1973 Carbonneau ..... 2/22
4,847,913 A * 7/1989 Chen ..... 2/463
5,301,370 A * 4/1994 Henson ..... 2/22
5,452,475 A 9/1995 Hunt, Jr.
5,590,826 A * 1/1997 Endo ..... 224/264
6,182,299 B1 * 2/2001 Chen ..... 2/463

* cited by examiner

*Primary Examiner*—Tejash Patel
(74) *Attorney, Agent, or Firm*—Armstrong, Kratz, Quintos, Hanson & Brooks, LLP

(57) ABSTRACT

A protector having a cover, composed of injection-molded thermoplastic elastomer and having plural convex portions protruding from a face side of the cover. A bending promotion portion is formed on a groove bottom between neighboring convex portions. The bending promotion portion is composed of a small bend protruding from the face side, and the cover is freely bent as to be convex on the face side.

9 Claims, 25 Drawing Sheets

PROTECTOR

BACKGROUND OF THE INVENTION

1. Field of the Invention

This invention relates to a protector.

2. Description of the Related Art

Conventional protectors have been produced by the following three methods. That is to say, a first protector is made by sandwiching a foamed block body having concavo-convex pattern (composed of polyethylene, polyurethane, ethylene-vinylacetate copolymer, etc.) between a cover and a lining (composed of synthetic leather, etc.) and sewing to form the concavo-convex pattern on the surface (refer to Japanese utility model application No. 7-37655).

A second protector is made by sandwiching a board of foamed body (composed of polyethylene, polyurethane, etc.) between a cover and a lining and (cooling or heating) compression molding with a mold as to form a concavo-convex pattern on the surface.

A third protector is made by sandwiching a foamed body between a cover, on which a concavo-convex pattern is preliminarily formed by compression molding, and a lining and sewing.

And, generally, a protector has shoulder belts and a waist belt wound around a body to put on the protector. And, a buckle male member is attached to each end of the shoulder belts and the waist belt, and buckle female members are attached to a main body side of the protector. Conventionally, the buckle female member is attached to the buckle male member through a belt-shaped attachment member, and disposed on an outer side to a border line of the protector main body.

However, in the conventional (three) protectors, convex and concave configurations and patterns on the surface are limited, and complicated configurations and patterns can not be formed on the surface. And, shock absorbability against shocks by speed ball and foul tip by the foamed body is limited. And, the cover may be damaged by spike shoes hitching on the cover when sliding is blocked.

And, in the conventional protector, the buckle female member may dangle and hit the body to generate strange feeling on the body, and may be damaged by a ball because the buckle female member is disposed outer to the border line of the main body of the protector when the protector is put on the body. And, a hitching claw portion of the buckle male member, hitching on the buckle female member, may be damaged. Further, damage such as breaking is caused in the belt-shaped attachment member by excessive bending force when the shoulder and waist belts are wound around the body because the belt-shaped attachment member is attached as to be fixed to the main body of the protector.

It is therefore an object of the present invention to provide a protector with which desired configurations and patterns can be formed on the surface, shock absorbability is improved, and damage on the surface is prevented, And, it is another object of the present invention to provide a protector with which the damage on the buckle female member and the buckle male member can be certainly prevented.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
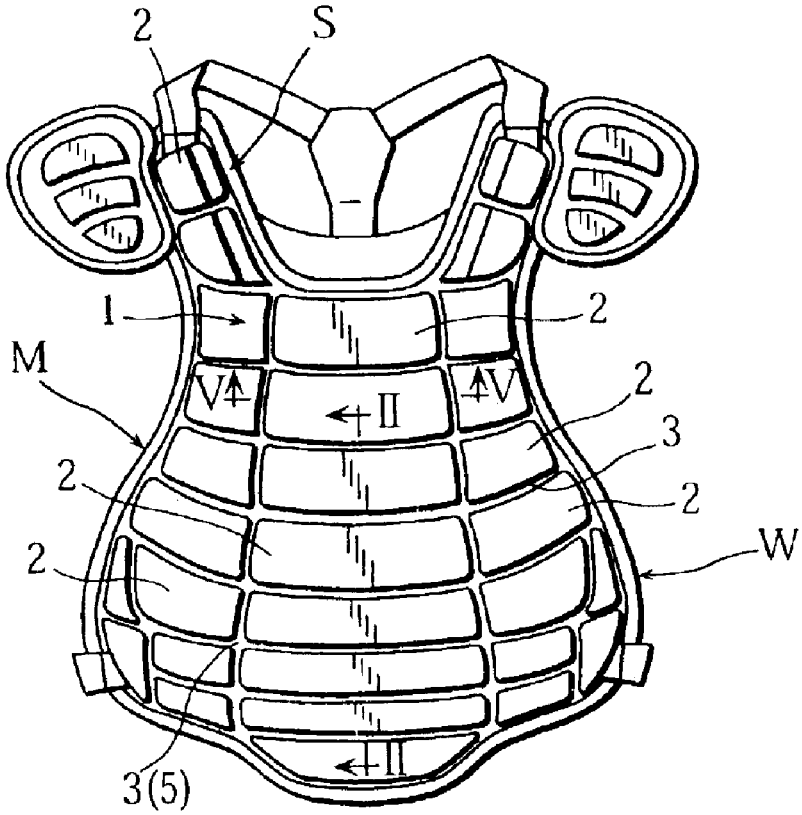
FIG. 1 is a front view showing an embodiment of the present invention.

FIG. 1 shows an embodiment of a protector relating to the present invention. This protector is provided with a protector main body M having a shoulder portion S and a waist portion W. The protector main body M is composed of a cover 1, a lining 10, and a board of foamed body 11 (of polyethylene, polyurethane, etc.) sandwiched by the cover 1 and the lining 10, sewn with machine sewing thread 9 to be united. The protector is used for umpires and players of sports such as baseball, softball, ice hockey, American football, and put on as to cover a front side of a bust (mainly chest and abdomen).

The cover 1 is composed of injection-molded thermoplastic elastomer (TPE) such as of polyurethane system, polyester system, polyethylene system, polystyrene system, etc.

The cover 1 has plural convex portions 2 protruding toward a face side, and a bending promotion portion 4 is formed on a groove bottom 3 between neighboring convex portions 2. The face side means a side opposite to the body.

The convex portion 2 has a peripheral wall portion (side wall portion) 13, a surface wall portion 14, and an inner space on a reverse side. The groove bottom 3 connects opening ends on the reverse side of the neighboring convex portions 2.

Figure 2:
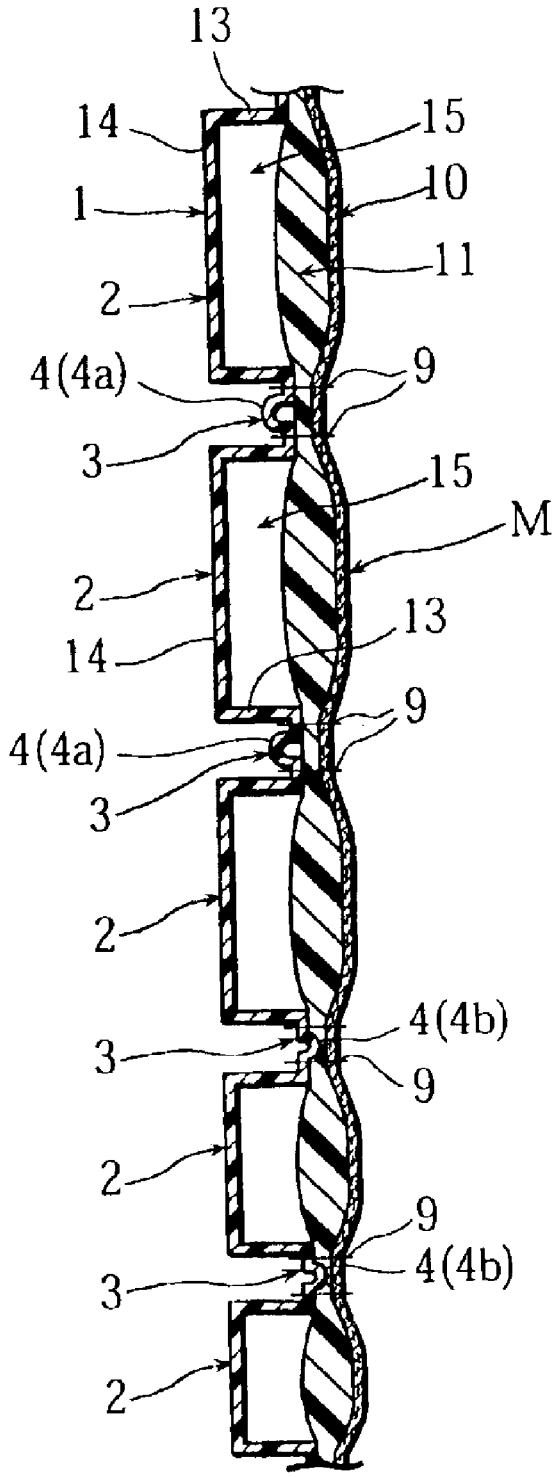
FIG. 2 is a cross-sectional view on II—II line of FIG. 1.

FIG. 2 shows the bending promotion portion 4 formed in a horizontal direction of the protector. The bending promotion portion 4 is composed of a convex small bent portion (small surface-protruding bend 4*a*) on the face side on approximately upper half of the protector, and composed of a convex small bent portion (small reverse-protruding bend 4*b*) on a reverse side on approximately lower half of the protector.

Figure 3A:
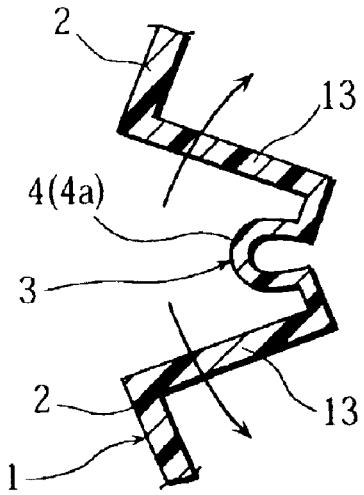
FIG. 3A is a working-explanatory view of a principal portion.

The small surface-protruding bend 4*a* is, as shown in FIG. 3A, composed as to facilitate the bend of the cover 1 in a diminishing direction of the small surface-protruding bend 4*a*. That is to say, the cover 1 is freely bent (elastically deformed) as to be convex to the face side in a direction to enlarge the groove. In other words, the cover 1 is hardly deformed in the opposite direction of FIG. 3A as to diminish the groove portion because the small protruding bend 4*a* interferes the peripheral wall portions 13.

Figure 3B:
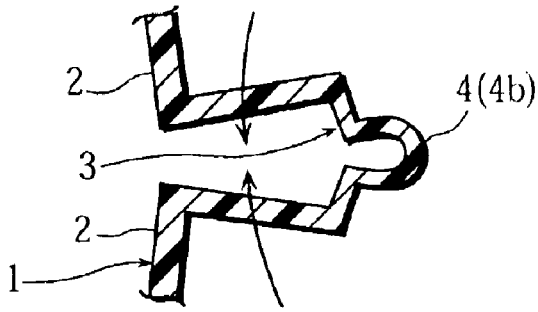
FIG. 3B is a working-explanatory view of a principal portion.

The small reverse-protruding bend 4*b* is, as shown in FIG. 3B, composed as to facilitate the bend of the cover 1 in a diminishing direction of the small reverse-protruding bend 4*b*. That is to say, the cover 1 is freely bent (elastically deformed) as to be convex to the reverse side in a direction to diminish the groove.

Figure 4A:
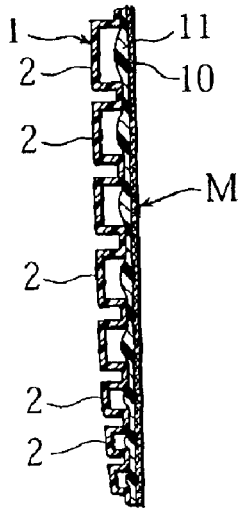
FIG. 4A is a general working-explanatory view.
Figure 4B:
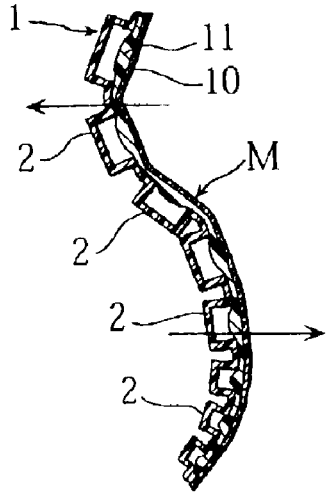
FIG. 4B is a general working-explanatory view.

Therefore, this protector is, as a whole, even if straight in vertical direction in unworn state as shown in FIG. 4A, easily bent corresponding to the contour of the body with the upper part bent convex to the face side and the lower part bent convex to the reverse side in wearing state as shown in FIG. 4B. The bending promotion portion 4 on the groove bottom 3 is omitted in FIGS. 4A and 4B.

Figure 5:
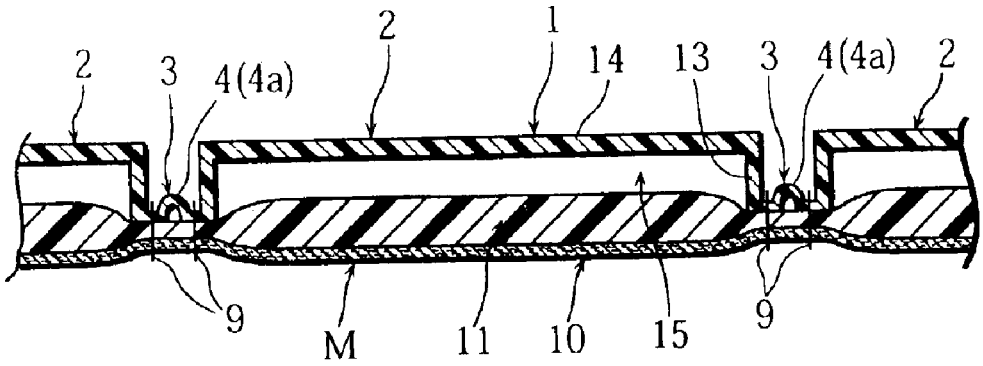
FIG. 5 is a cross-sectional view on V—V line of FIG. 1.
Figure 6:
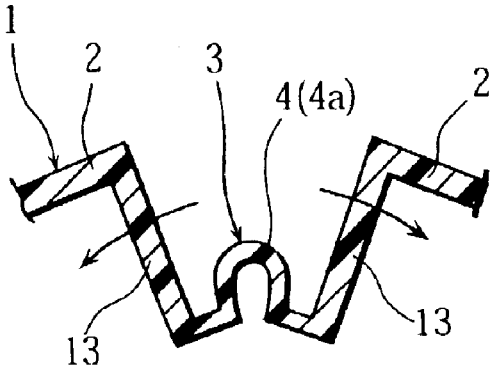
FIG. 6 is a working-explanatory view of a principal portion.

And, FIG. 5 shows the bending promotion portion 4 formed in vertical direction of the protector. The bending promotion portion 4 is composed of a convex small bent portion (small surface-protruding bend 4*a*) on the face side, and the small surface-protruding bend 4*a* is, as shown in FIG. 6, composed as to facilitate the bend of the cover 1 in a diminishing direction of the small surface-protruding bend 4*a*. That is to say, the cover 1 is freely bent (elastically deformed) as to be convex to the face side in a direction as the groove is enlarged.

Figure 7A:
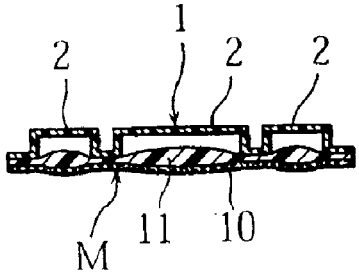
FIG. 7A is a general working-explanatory view.
Figure 7B:
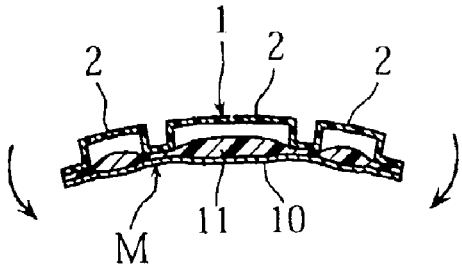
FIG. 7B is a general working-explanatory view.

Therefore, this protector is, as a whole, even if straight in horizontal direction in unworn state as shown in FIG. 7A, easily bent convex to the face side as to correspond to the contour of the body. The bending promotion portion 4 on the groove bottom 3 is omitted in FIGS. 7A and 7B.

The configuration of the bending promotion portion 4 may be a small protrusion of which cross section is triangle, a configuration composed of plural small bends serially disposed, or any configuration which promotes the bend of the cover 1.

Figure 8:
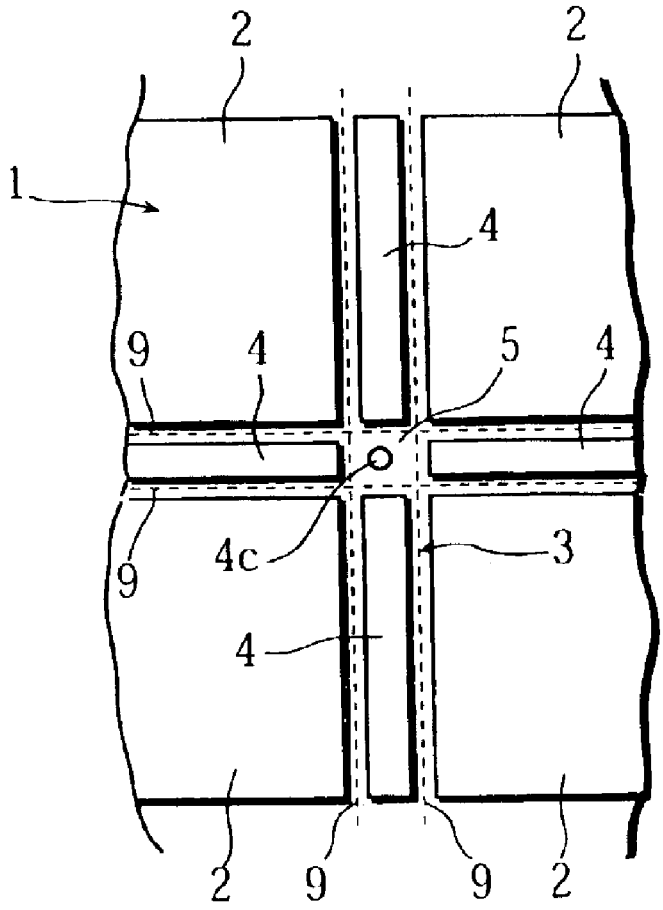
FIG. 8 is an enlarged front view of a principal portion.

As shown in FIGS. 2, 5, and 8, two lines of machine sewing thread 9 sewn to the lining 10 are disposed on both sides of the bending promotion portion 4 (the small surface-protruding bend 4*a* and the small reverse-protruding bend 4*b*) as not to interfere the bending promotion portion 4.

As shown in FIG. 8, the bending promotion portion 4 is partially omitted on a crossing portion 5 of the groove bottom 3 as to avoid the machine sewing thread 9. The crossing portion 5 is a portion on which the groove in vertical direction crosses the groove in horizontal direction, and "partially omitted" means omitted as not to interfere the running of the machine sewing thread 9 in vertical and horizontal directions. And, although a circular deformation promotion portion 4C is disposed on a position in the crossing portion 5 surrounded by the machine sewing thread 9, this deformation promotion portion 4C may be omitted.

Figure 9:
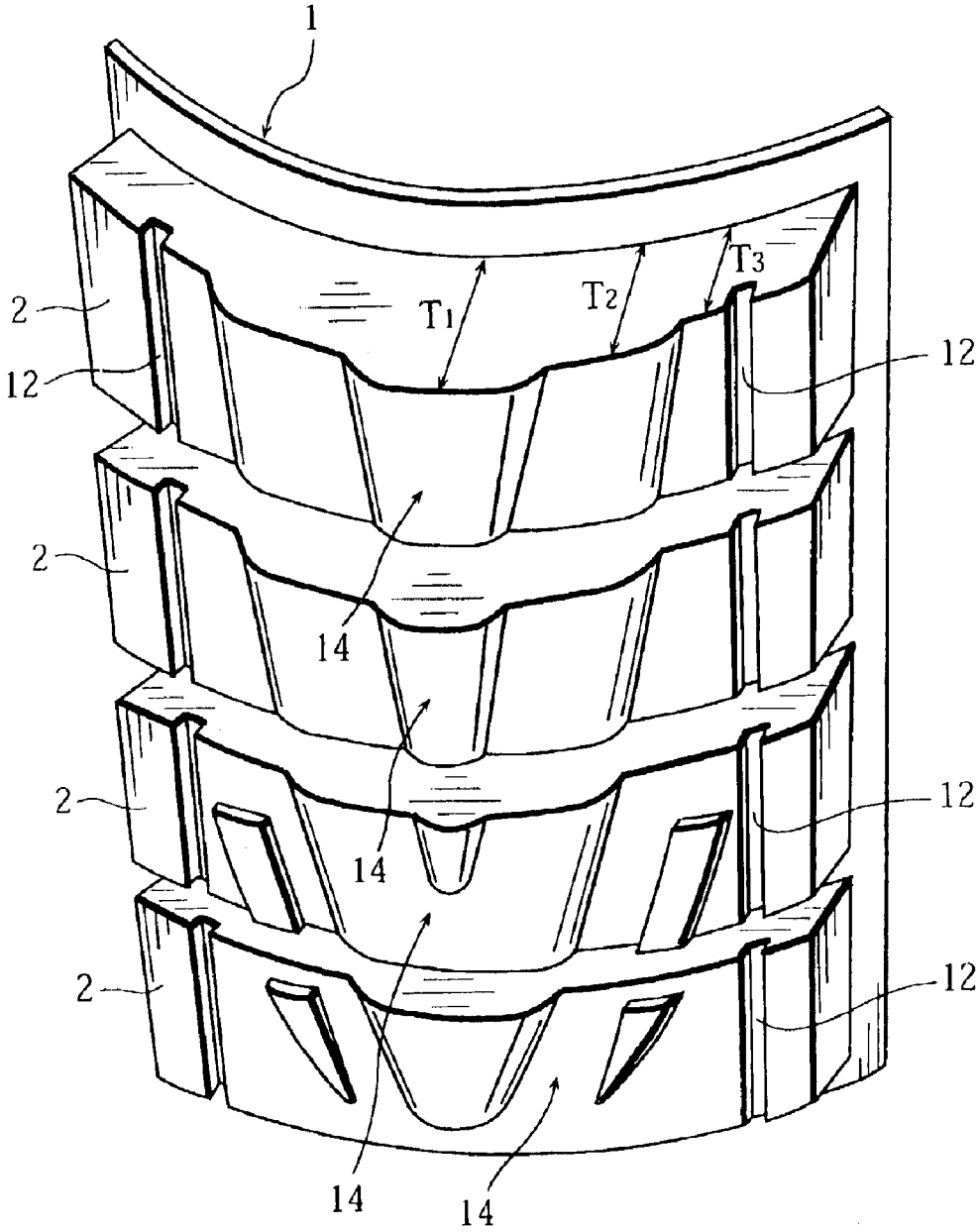
FIG. 9 is a perspective view showing another embodiment of the cover.

The above-described convex portion 2, the groove bottom 3, and the bending promotion portion 4 are unitedly formed by injection molding. And, as shown in FIG. 9, the surface wall portion 14 of the convex portion 2 may be formed preliminarily into a curved face, a concavo-convex face, or an inclined face. And, the surface of the cover may be formed preliminarily into a leather-grain pattern. For example, the thickness of the convex portion 2 is varied on parts as to have a large thickness $T_1$, a medium thickness $T_2$, and a small thickness $T_3$, a groove 12 may be disposed on the convex portion 12, and the surface of the convex portion 2 may be formed into an inclined face as the thickness of the convex portion 2 gradually decreases downward. Further, as shown in FIG. 9, the reverse side of the cover 1 may be preliminarily formed into a concave curved face corresponding to the body. And, although not shown in Figures, the face of the cover 1 may be preliminarily formed into a leather-grain pattern. In short, these configurations and patterns can be easily formed on the cover 1 by forming an injection mold into these configurations and patterns.

Figure 10A:
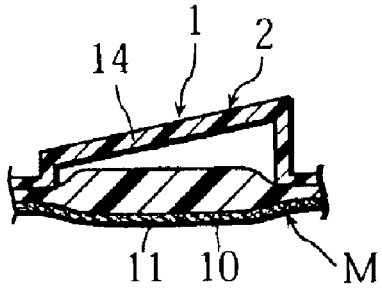
FIG. 10A is an explanatory cross-sectional view showing another embodiment.
Figure 10B:
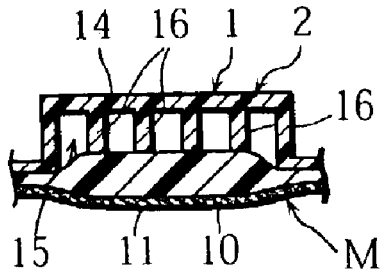
FIG. 10B is an explanatory cross-sectional view showing still another embodiment.

In the configuration of the convex portion 2 of the cover 1, not restricted to the embodiments described above, the surface wall portion 14 of the convex portion 2 may be inclined as not to directly receive the shock of such as a ball as shown in FIG. 10A. And, plural rib portions 16 which contact the foamed body 11 may be disposed in the inner space 15 of the convex portion 2 and on the reverse side of the surface wall portion 14 for shock resistance as shown in FIG. 10. Further, cushion of the convex portion 2 is soft only with the air layer of the inner space 15 of the convex portion 2 as shown in FIG. 2, and the cushion is made hard by the rib portions 16 in the inner space 15 of the convex portion 2.

Figure 10C:
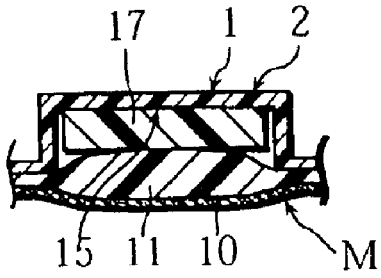
FIG. 10C is an explanatory cross-sectional view showing a further embodiment.
Figure 10D:
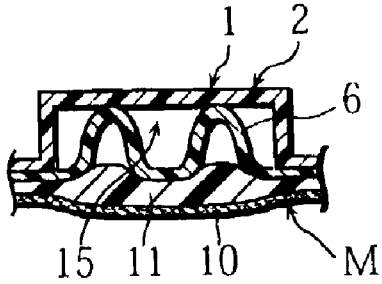
FIG. 10D is an explanatory cross-sectional view showing a still further embodiment.
Figure 10E:
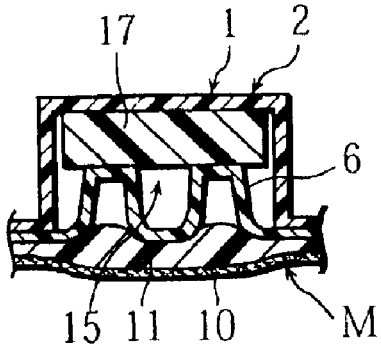
FIG. 10E is an explanatory cross-sectional view showing another embodiment.

And, a foamed block body 17 (of polyethylene, polyurethane, ethylene-vinylacetate copolymer, etc.) may be disposed in the inner space 15 of the convex portion 2 as shown in FIG. 10C, an elastic member 6 may be disposed in the inner space 15 of the convex portion 2 as shown in FIG. 10D, and, the foamed block body 17 and the elastic member 6 may be disposed in the inner space 15 of the convex portion 2 as shown in FIG. 10E to increase degree of freedom of shock resistance. The elastic member 6 is, for example, composed of a spring such as a plate spring and a belleville spring made of injection-molded TPE (thermoplastic elastomer).

Further, although not shown in Figures, the rib portions 16 and the foamed block body 17 may be set in the inner space 15 of the convex portion 2, and the thickness of the surface wall portion 14 of the convex portion 2 may be increased to enhance the shock resistance.

Figure 11A:
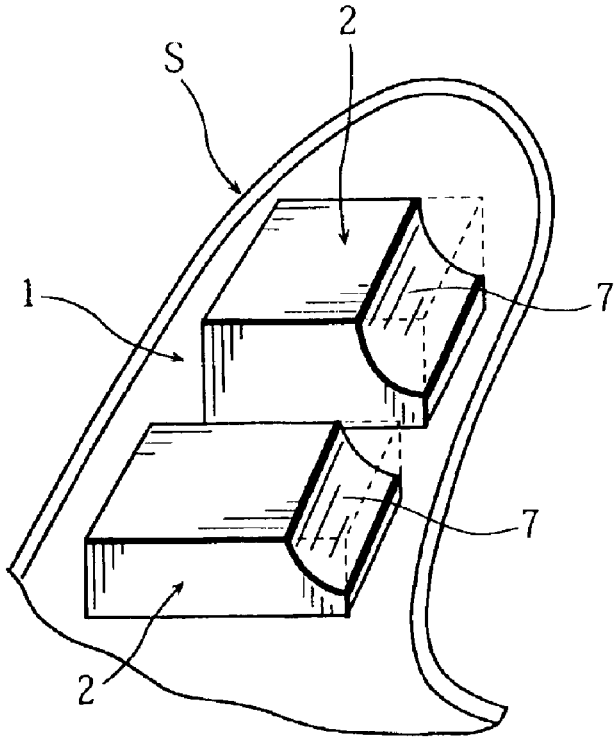
FIG. 11A is an explanatory perspective view showing a convex portion on a shoulder portion.
Figure 11B:
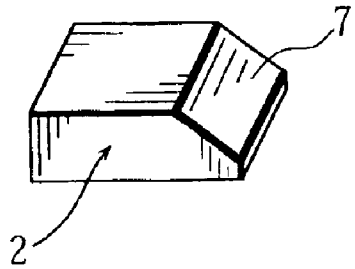
FIG. 11B is an explanatory perspective view showing a convex portion on the shoulder portion.

Next, as shown in FIG. 11A, a notched portion 7 for escapement from interference of a mask, having a concave curved configuration, is formed on the convex portion 2 disposed on the shoulder portion S of the protector. The notched portion 7 is formed by injection molding, and the convex portion 2 has no problems in strength and shock resistance for regulation of thickness dimension. The configuration of the notched portion 7 may be an inclined face as shown in FIG. 11B. Therefore, although a mask and lower parts of the mask currently tend to be large and a throat guard is preferred to wear, the mask (or the throat guard) does not contact the convex portions 2 on the left and right shoulder portions S even if a player shakes his/her head during the game.

Figure 12A:
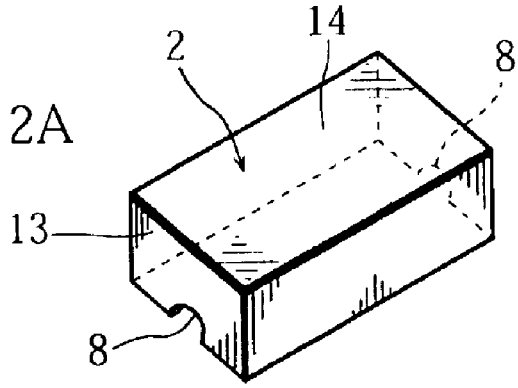
FIG. 12A is an explanatory perspective view showing another embodiment of the convex portion.
Figure 12B:
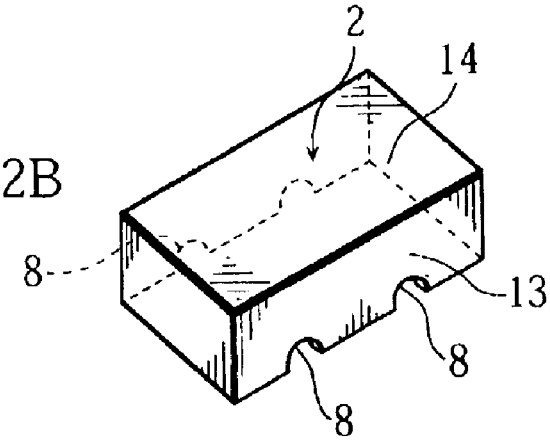
FIG. 12B is an explanatory perspective view showing another embodiment of the convex portion.

Next, as shown in FIG. 12A, radiation holes 8 may be formed through left and right side walls of the peripheral wall portion 13 of the convex portion 2. The peripheral wall portion 13 is formed by injection molding, and the radiation holes 8 may be formed on upper and lower side walls. And, the peripheral wall portion 13 has no problem in strength and shock resistance.

Figure 13:
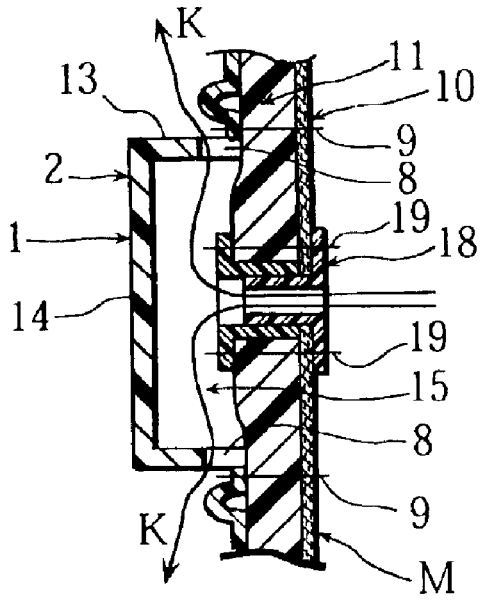
FIG. 13 is a cross-sectional view of a principal portion.

And, as shown in FIG. 13, a ventilation pipe 18 is insertedly attached to a position of the lining 10 and the foamed body 11 facing the inner space 15 of the convex portion 2 by sewing with the machine sewing thread 9. The heat being generated by the body, is radiated from the reverse side of the protector to the face side of the protector through the hole of the ventilation pipe 18 as shown with arrows K, the inner space 15 of the convex portion 2, and the holes 8 of the convex portion 2.

Figure 14:
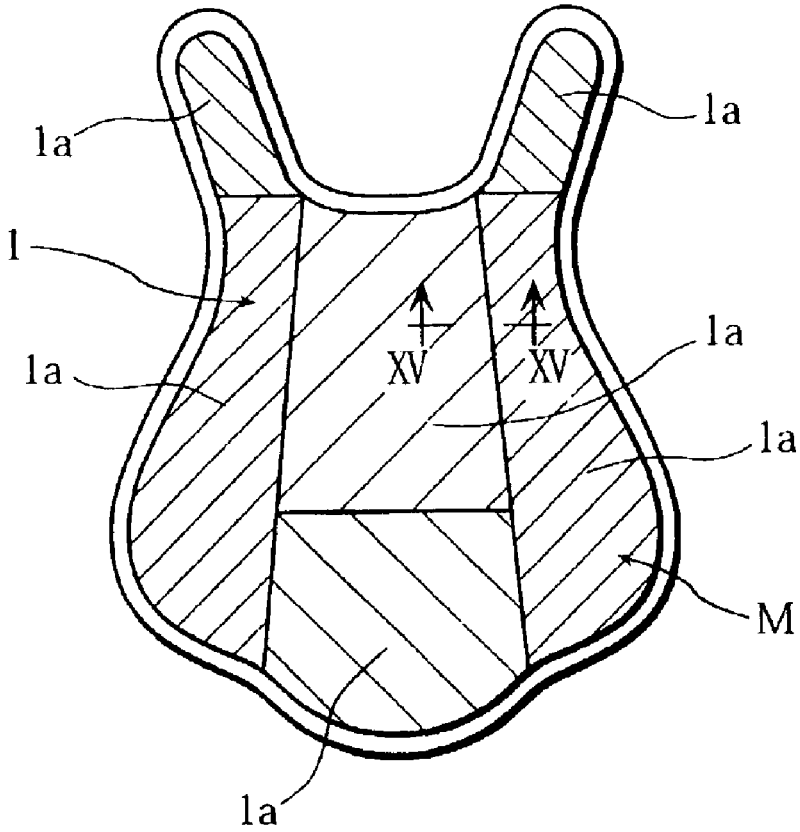
FIG. 14 is a schematic explanatory view showing another embodiment.
Figure 15:
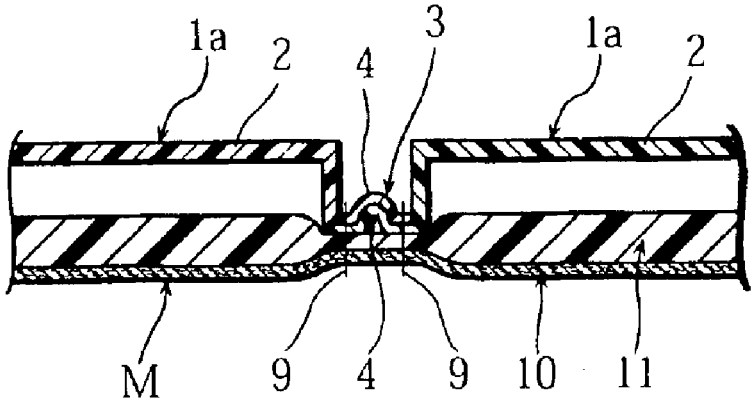
FIG. 15 is a cross-sectional view on XV—XV line of FIG. 14.

Although the face side of the protector shown in FIG. 1 is composed of one cover 1, the cover 1 may have a block construction as shown in FIG. 14. That is to say, the cover 1 of the protector is divided into plural parts to make plural divided cover pieces 1*a*, and neighboring divided cover pieces 1*a* are sewn with two lines of the machine sewing thread 9 as the bending promotion portions 4 of the cover pieces 1*a* are layered. That is to say, as a finished product, neighboring divided cover pieces 1*a* are layered on the groove bottom 3 between the convex portions 2 and sewn by the machine sewing thread 9 together with the lining 10 and the foamed body 11. Further, it is desirable to color the divided cover pieces 1*a* with 2 to 6 different colors.

Figure 16:
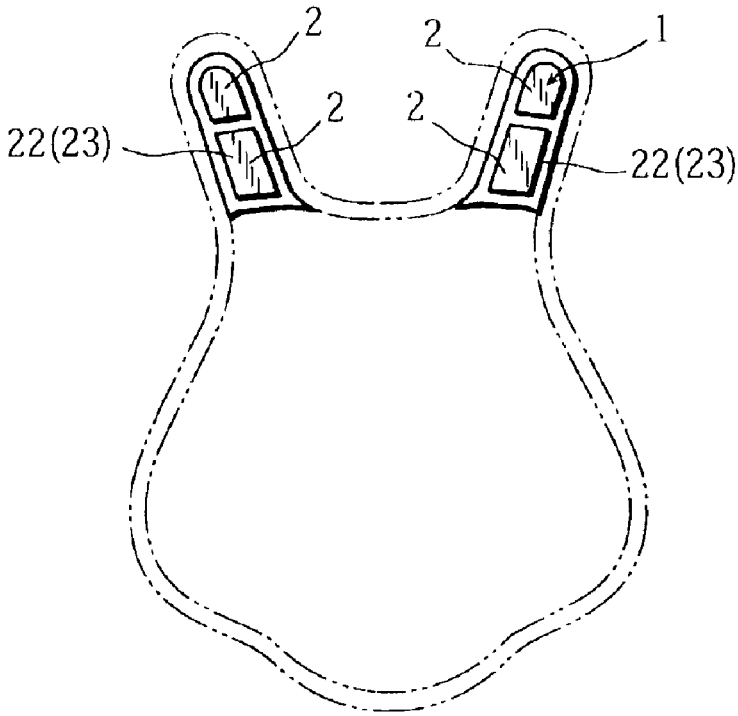
FIG. 16 is a schematic explanatory view showing another embodiment.

FIG. 16 shows another embodiment. A reinforced portion 22 of the cover 1 is composed of injection-molded thermoplastic elastomer, and the cover 1 has plural convex portions 2 protruding to the face side. The reinforced portion 22 is composed of a clavicle portion 23. In other words, the cover 1 is made as a block construction, and only one divided block or several blocks may be composed of the thermoplastic elastomer.

Figure 17:
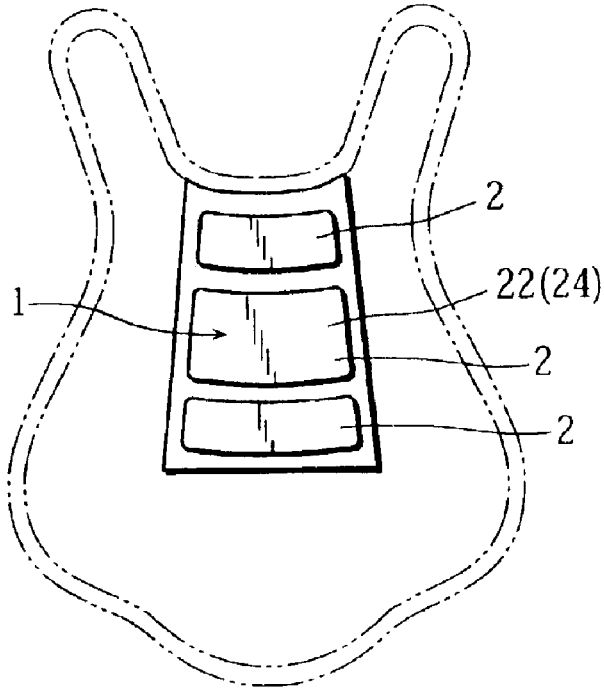
FIG. 17 is a schematic explanatory view showing still another embodiment.

FIG. 17 shows another embodiment. A reinforced portion 22 of the cover 1 is composed of injection-molded thermoplastic elastomer, and the cover 1 has plural convex portions 2 protruding to the face side. The reinforced portion 22 is composed of a dovetail portion 24. In other words, the cover 1 is made as a block construction, and only one divided block is composed of the thermoplastic elastomer.

Figure 18:
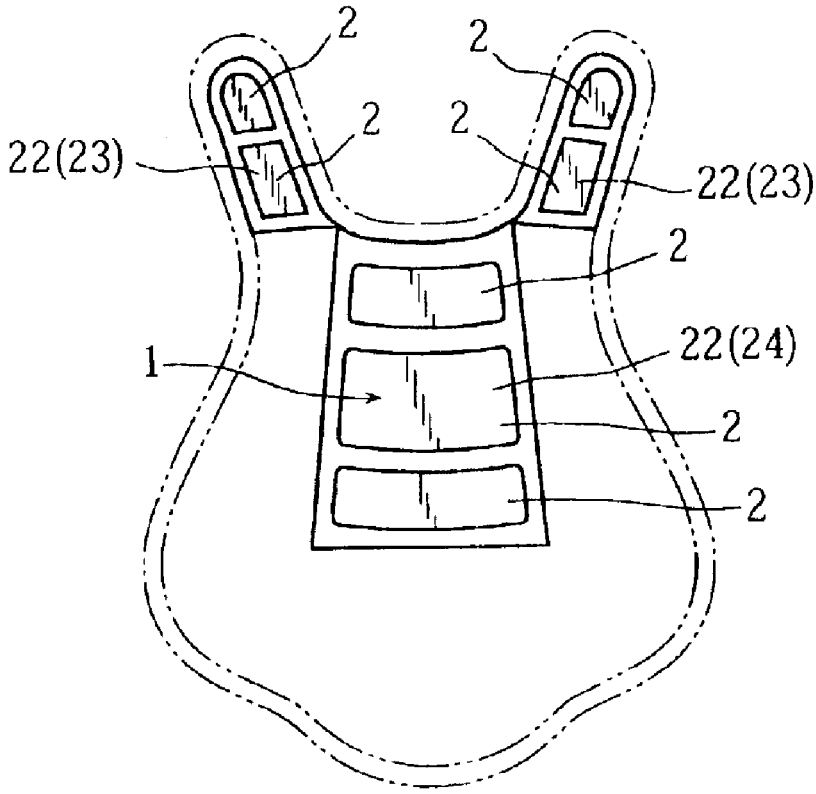
FIG. 18 is a schematic explanatory view showing a further embodiment.

FIG. 18 shows still another embodiment. A reinforced portion 22 of the cover 1 is composed of injection-molded thermoplastic elastomer, and the cover 1 has plural convex portions 2 protruding to the face side. The reinforced portion 22 is composed of a clavicle portion 23 and a dovetail portion 24. In other words, the cover 1 is made as a block construction, and only one divided block or several blocks may be composed of the thermoplastic elastomer.

The reinforced portion 22 is shown with a solid line in FIGS. 16 through 18. Other parts shown with two-dot broken lines have conventional constructions.

Figure 19:
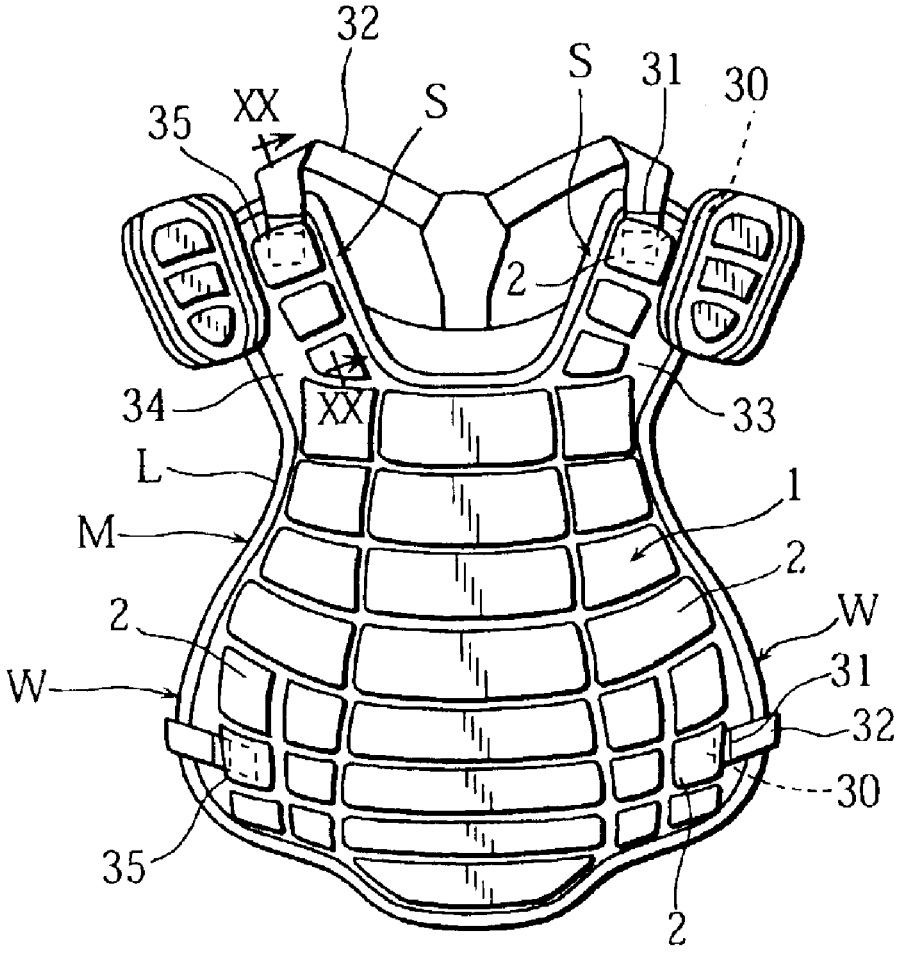
FIG. 19 is a schematic explanatory view showing another embodiment.
Figure 20:
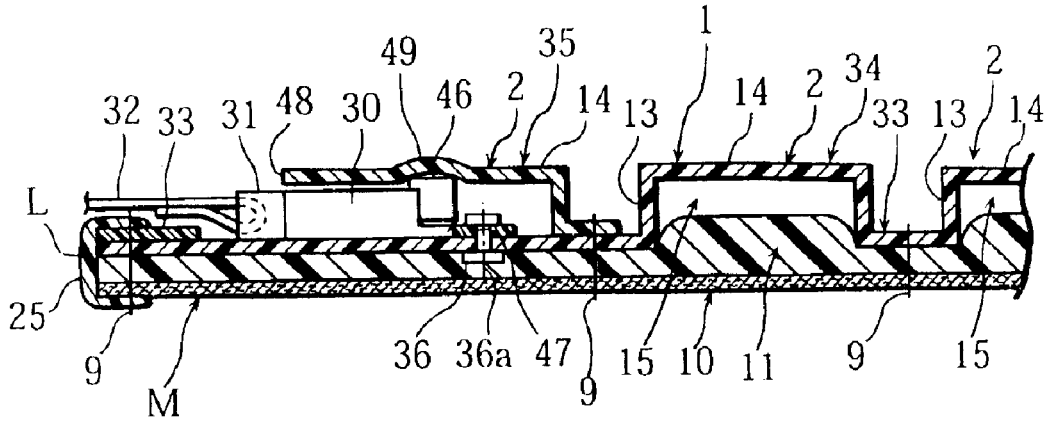
FIG. 20 is a cross-sectional view on XX—XX line of FIG. 19.

FIG. 19 and FIG. 20 show another embodiment. A belt 32 is attached to each of the shoulder portion S and the waist portion W, and the protector main body M is put on the body by winding the belts 32 around the body.

The cover 1 has a reverse wall portion 33 and plural convex portions 2 formed on the reverse wall portion 33 and protruding to the face side. The cover 1 has a block construction composed of a base cover 34 which occupies most of the protector main body M and an attached cover 35 attached later to the base cover 34 (by sewing).

A buckle male member 31 is attached to an end portion of the belt 32, and a buckle female member 30, detachably hitching on the buckle male member 31, is attached to the protector main body M side.

The buckle female member 30 is attached to the cover 1 as to be on an inner side to an border line L of the protector main body M and covered by the convex portion 2.

To describe concretely, the buckle female member 30 is attached to the reverse wall portion 33 of the base cover 34 with a shaft member 36 (such as a caulking pin) as to freely oscillate around an axis 36*a* of the shaft member 36. And, the buckle female member 30 is covered by the convex portion 2 of the attached cover 35.

Figure 21:
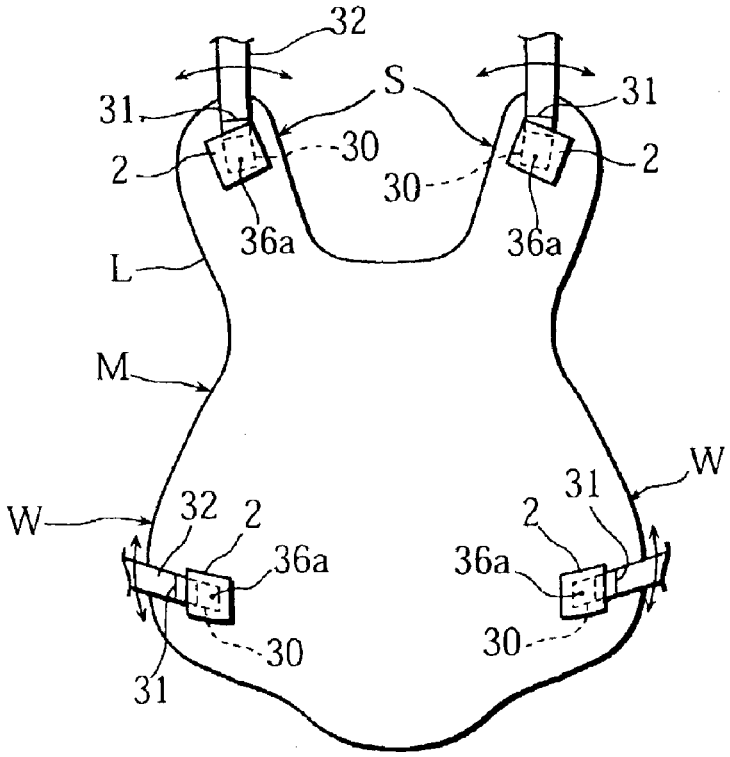
FIG. 21 is a general working-explanatory view.

Therefore, as shown in FIG. 21, the buckle female member 30 does not contact the body and cause strange feelings when the protector is put on the body in use, and the buckle female member 30 is prevented from breaking by contact with a ball, etc. because the buckle female member 30 is disposed on the inner side to the border line L of the protector main body M, covered by the convex portion 2, and oscillatable around the axis 36*a*. Further, the belt 32 wound around the body causes no strange feeling, and the buckle female member 30 is hardly broken without excessive bending force working on parts of the buckle female member 30 because the buckle female member 30 freely changes its direction on the protector main body M side.

Further, in a hitching state in which a hitching claw portion 40 (refer to FIG. 22) of the buckle male member 31 is hitched to the buckle female member 30, the buckle male member 31 (especially, the hitching claw portion 40) can be prevented from breaking because the buckle male member 31 is positioned on an inner side to the border line L and the hitching claw portion 40 of the buckle male member 31 is covered by the convex portion 2 along with the buckle female member 30. And, the buckle male member 31 is hardly broken without excessive bending force working on the buckle male member 31 because the buckle male member 31 can change its direction along with the buckle female member 30.

One (or the both) of the buckle female members 30, hitching on the buckle male member 31 on the both end portions of the belts 32, may be fixed.

Figure 22:
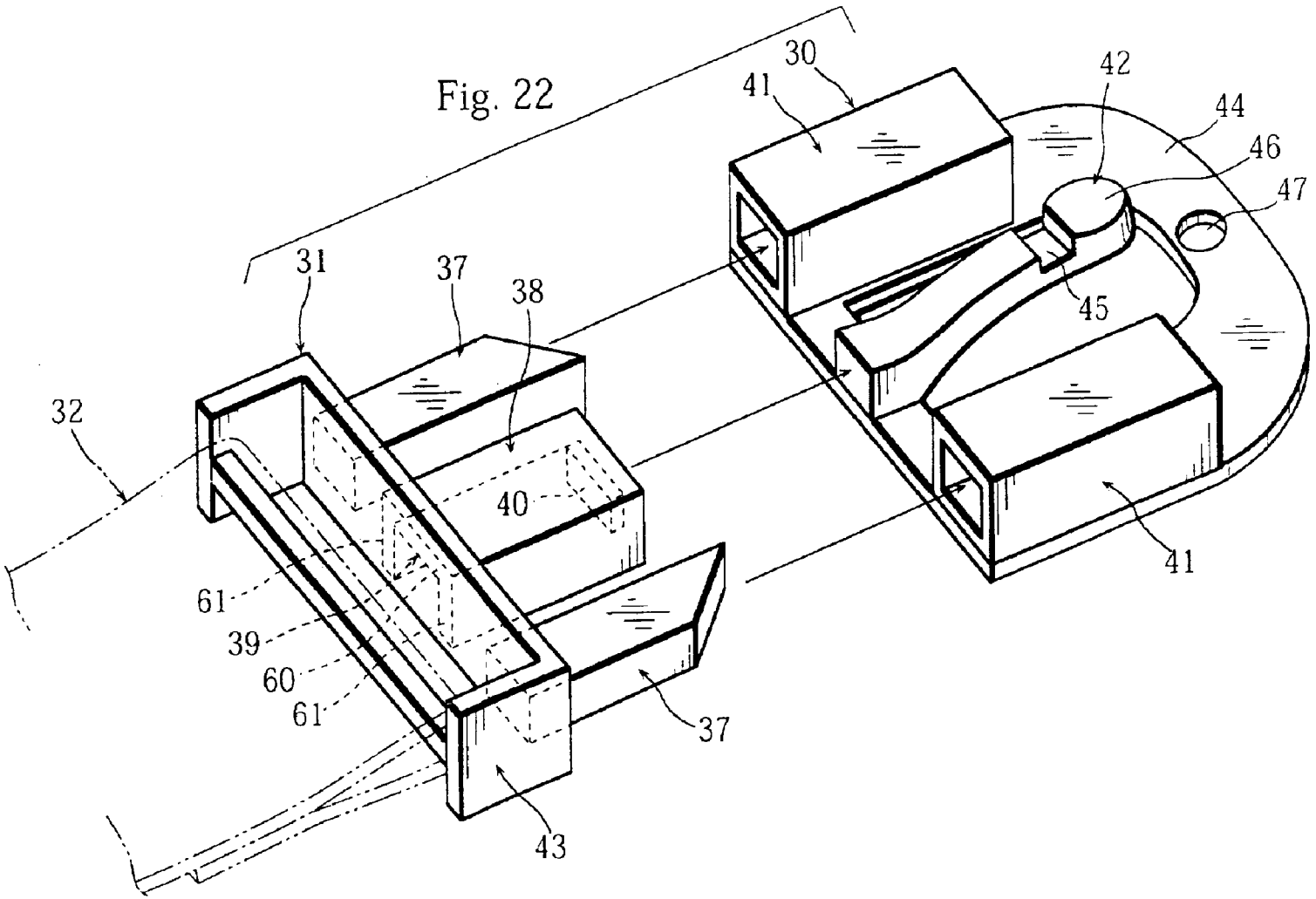
FIG. 22 is a perspective view showing buckle male and female members.

Next, as shown in FIG. 22, the buckle male member 31 has two guiding leg portions 37, a hitching leg portion 38 disposed between the two guiding leg portions 37, and a belt attachment portion 43 to which the belt 32 is attached and the two guiding leg portions 37 and the hitching leg portion 38 are fixed.

The hitching leg portion 38 has a configuration opening toward a forth end side and having at least an upper wall portion 60 and left and right side wall portions 61. To describe concretely, the hitching leg portion 38 has a concave groove portion 39 opening downward (to the reverse side), and the hitching claw portion 40 is disposed on the concave groove portion 39 as to protrude downward (to the reverse side). That is to say, the hitching claw portion 40 is prevented from breaking because the hitching claw portion 40 is hidden inside the hitching leg portion 38.

The buckle female member 30 has guiding cylinder portions 41 to which the guiding leg portions 37 of the buckle male member 31 are inserted, an elastically-deformable hitching portion 42 fitted into the concave groove portion 39 in the hitching leg portion of the buckle male member 31, and a base portion 44 to which an end of the elastically-deformable hitching portion 42 and the guiding cylinder portions 41 are fixed.

A hitching concave portion 45, hitched by the hitching claw portion 40 of the hitching leg portion 38, and a pressed portion 46 to oscillate the elastically-deformable hitching portion 42 in vertical direction (as to be bent), are disposed on the other end of the elastically-deformable hitching portion 42. And, a hole portion 47, to which the shaft portion 36 (refer to FIG. 20) is inserted, penetrates the base portion 44.

Figure 23A:
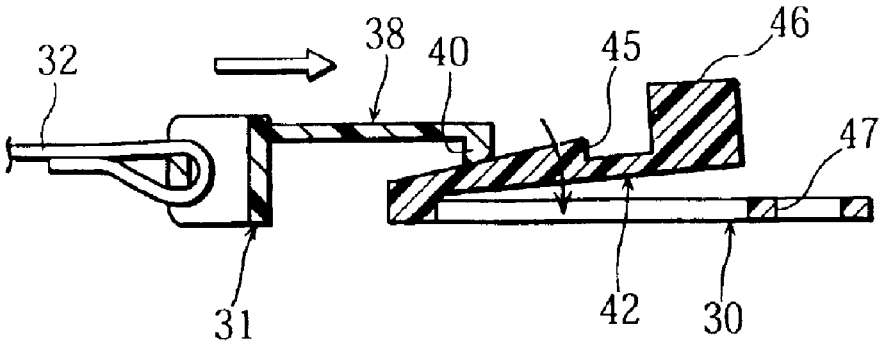
FIG. 23A is a working-explanatory cross-sectional view of a principal portion.
Figure 23B:
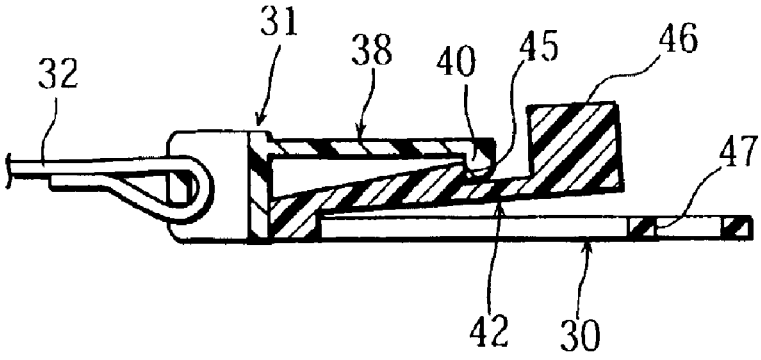
FIG. 23B is a working-explanatory cross-sectional view of the principal portion.
Figure 23C:
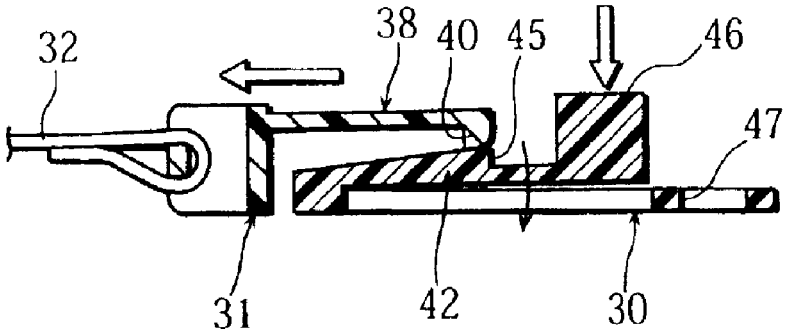
FIG. 23C is a working-explanatory cross-sectional view of the principal portion.

Next, hitching of the buckle male member 31 to the buckle female member 30 is described. As shown in FIG. 22, while the guiding leg portions 37 of the buckle male member 31 are inserted to the guiding cylinder portions 41 of the buckle female member 30 and the hitching leg portion 38 of the buckle male member 31 is fitted to the elastically-deformable hitching portion 42 of the buckle female member 30, the hitching claw portion 40 of the buckle male member 31 presses and oscillates the elastically-deformable hitching portion 42 of the buckle female member 30 downward as shown in FIG. 23A, and the buckle male member 31 is hitched on the buckle female member 30 by the hitching claw portion 40 fitting to the hitching concave portion 45 as shown in FIG. 23B. To describe release of the buckle male member 31 from the buckle female member 30, as shown in FIG. 23C, the buckle male member 31 can be released from the buckle female member 30 by pulling off the buckle male member 31 while the pressed portion 46 is pressed downward to oscillate the elastically-deformable hitching portion 42 downward.

Figure 24:
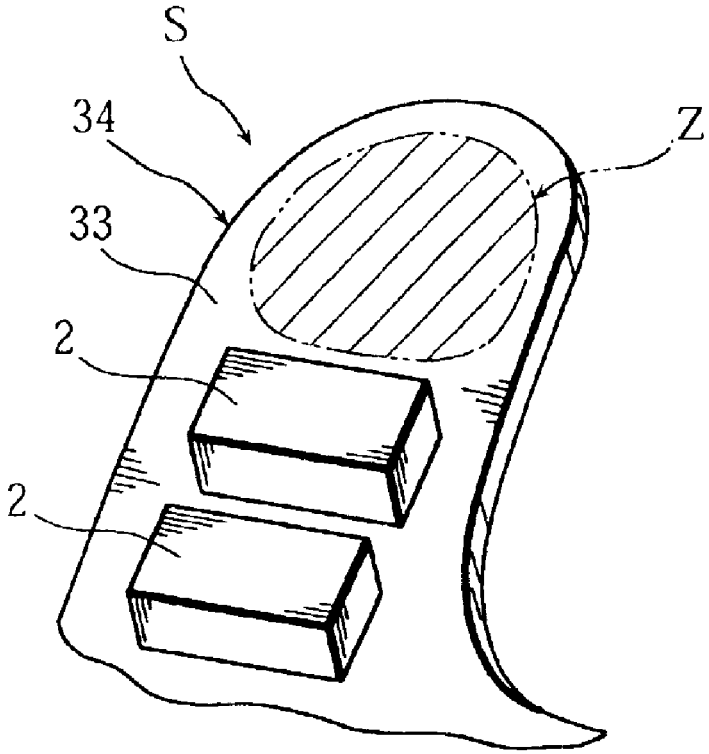
FIG. 24 is an enlarged perspective view of a principal portion.
Figure 25:
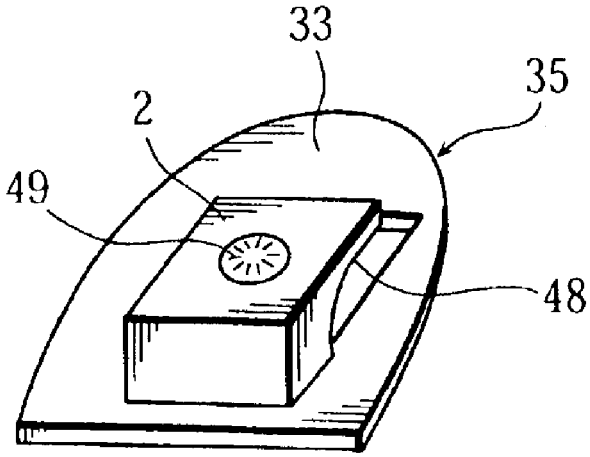
FIG. 25 is a perspective view of a principal portion.

Next, to describe the attachment of the buckle female member 30 to the protector main body M on the shoulder portion S, first, as shown in FIG. 24, the base cover 34 is formed as to have a flat attachment area Z to which the buckle female member 30 is attached, and the attached cover 35 is formed as to have the convex portion 2 having a notched portion 48 for escapement of the buckle as shown in FIG. 25.

And, as shown in FIG. 20, the buckle female member 30 is attached on the reverse wall portion 33 (the attachment area Z) of the base cover 34 with the shaft member 36, and the attached cover 35 is placed on the base cover 34 as to cover the buckle female member 30 with the convex portion 2 from the surface side, then, the buckle female member 30 is attached to the protector main body M by sewing the attached cover 35, the base cover 34, the foamed body 11, and the lining 10 as to be united with a rim-binding portion 25 and the machine sewing thread 9.

As shown in FIG. 20 and FIG. 25, the pressed portion 46 can be pressed by pressing an elastically-deformable small convex portion 49 having thin wall, disposed on a part of the convex portion 2 (the surface wall portion 14) of the attached cover 35 facing the pressed portion 46 of the buckle female member 30, from the outside. The buckle male member 31 can be inserted to the buckle female member 30 through the notched portion 48 of the attached cover 35, and the notched portion 48 does not interfere the oscillation of the buckle female member 30.

Although not shown in Figures, the buckle female member 30 may be covered by another lid member (of polyacetal, etc.).

Figure 26:
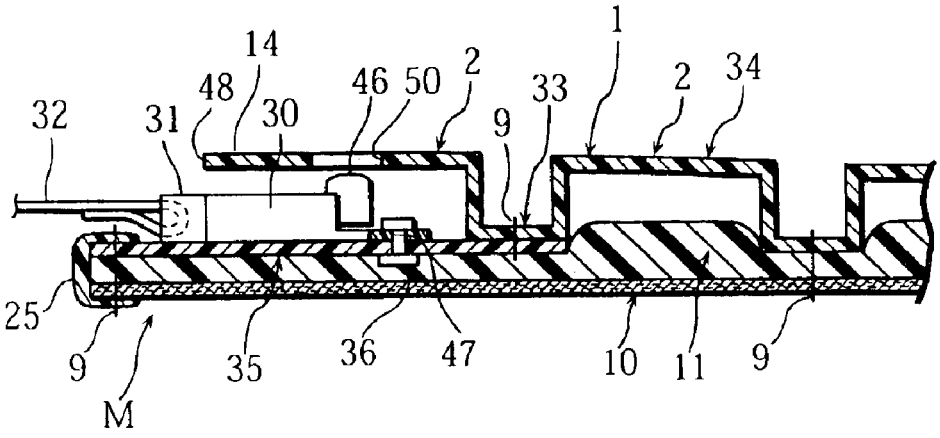
FIG. 26 is a cross-sectional view showing another embodiment of attachment state.

Next, another attached state of the buckle female member 30 to the protector main body M is shown in FIG. 26. After the buckle female member 30 is attached to the attached cover 35 with the shaft member 36, the attached cover 35 is sewn with the machine sewing thread 9 from the reverse side of the base cover 34, and the buckle female member 30 is attached to the protector main body M by sewing the attached cover 35, the foamed body 11, and the lining 10 with the rim-binding portion 25 and the machine sewing thread 9.

An operational hole portion 50 penetrates a position on the convex portion 2 (the surface wall portion 14) of the base cover 34 facing the pressed portion 46 of the buckle female member 30 as the pressed portion 46 can be pushed from outside. And, a notched portion 48 for escapement of the buckle is disposed on the convex portion 2 of the base cover 34.

Figure 27:
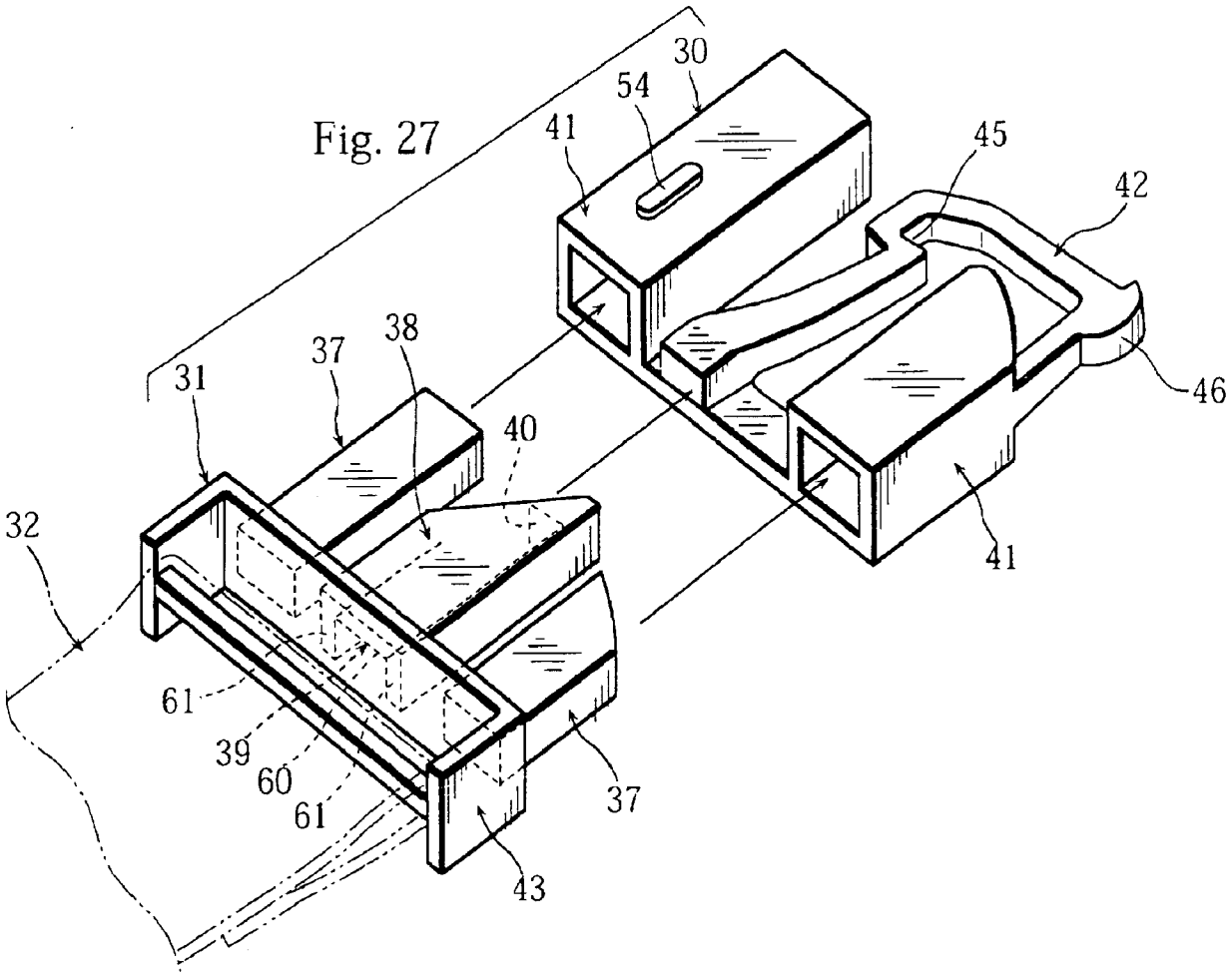
FIG. 27 is a perspective view showing another embodiment of the buckle male and female members.

Next, another embodiment of the buckle female member 30 and the buckle male member 31 is shown in FIG. 27. The following construction is clearly different in comparison with FIG. 22. That is to say, although the hitching claw portion 40 and the hitching concave portion 45 are hitched and released in up-and-down directions (vertical directions) in FIG. 22, the hitching claw portion 40 and the hitching concave portion 45 are hitched and released in left-and-right directions (horizontal directions) in FIG. 27. To describe concretely, the hitching claw portion 40 is disposed in the concave groove 39 of the hitching leg portion 38 as to laterally protrude, the hitching concave portion 45 is formed concave in lateral direction on the elastically-deformable hitching portion 42, and the pressed portion 46 is constructed as to oscillate the elastically-deformable hitching portion 42 in horizontal direction (as to be bent). The both end portions of the elastically-deformable hitching portion 42 are fixed.

Figure 28A:
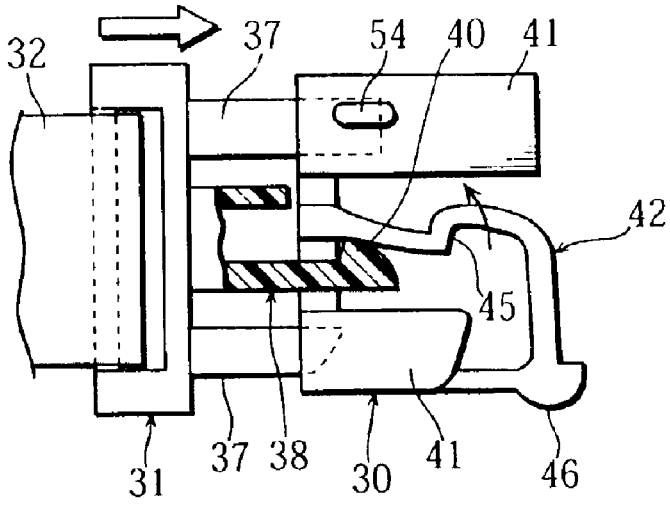
FIG. 28A is a working-explanatory top view of a principal port ion.
Figure 28B:
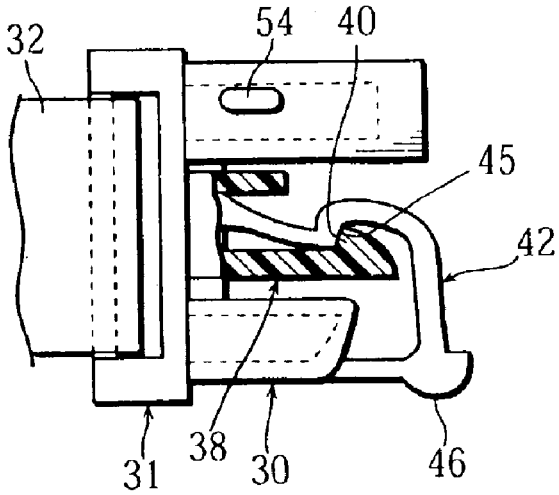
FIG. 28B is a working-explanatory top view of the principal port ion.
Figure 28C:
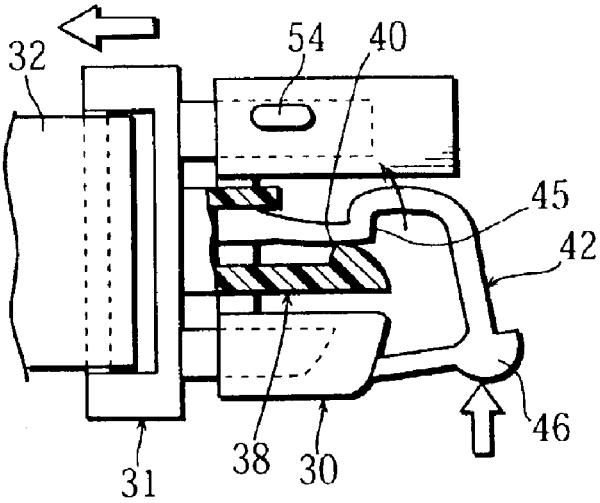
FIG. 28C is a working-explanatory top view of the principal portion.

And, hitching of the buckle male member 31 to the buckle female member 30 is described. As shown in FIG. 28A, while the guiding leg portions 37 of the buckle male member 31 are inserted to the guiding cylinder portions 41 of the buckle female member 30 and the hitching leg portion 38 of the buckle male member 31 is fitted to the elastically-deformable hitching portion 42 of the buckle female member 30, the hitching claw portion 40 of the buckle male member 31 presses and oscillates the elastically-deformable hitching portion 42 of the buckle female member 30 in lateral direction, and the buckle male member 31 is hitched on the buckle female member 30 by the hitching claw portion 40 fitting to the hitching concave portion 45 as shown in FIG. 28B. On the other hand, as shown in FIG. 28C, the buckle male member 31 can be released from the buckle female member 30 by pulling off the buckle male member 31 while the pressed portion 46 is pressed in lateral direction to oscillate the elastically-deformable hitching portion 42 in lateral direction.

Figure 29:
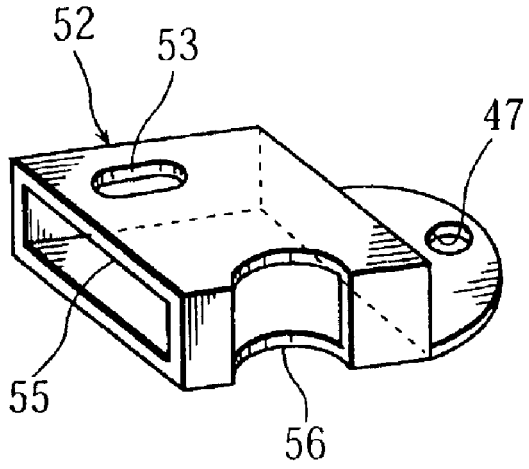
FIG. 29 is a perspective view showing an oscillation cover member.
Figure 30:
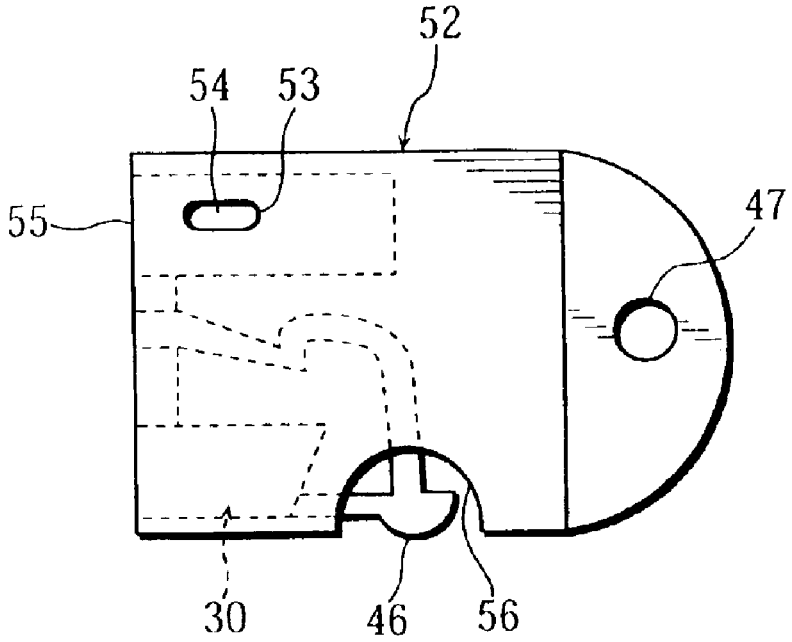
FIG. 30 is a top view.

And, buckle female member 30 shown in FIG. 27 is covered by an oscillation cover member 52 shown in FIG. 29 for reinforcement. That is to say, as shown in FIG. 29 and FIG. 30, the oscillation cover member 52 is a hollow body in which an opening portion 55 for insertion of the buckle female member 30, a positioning hole 53 to which a positioning protrusion 54 of the buckle female member 30 is fitted, a notched portion 56 to expose the pressed portion 46 of the buckle female member 30, and a hole portion 47 for insertion of the shaft member 36 (refer to FIG. 20) are formed.

Figure 31:
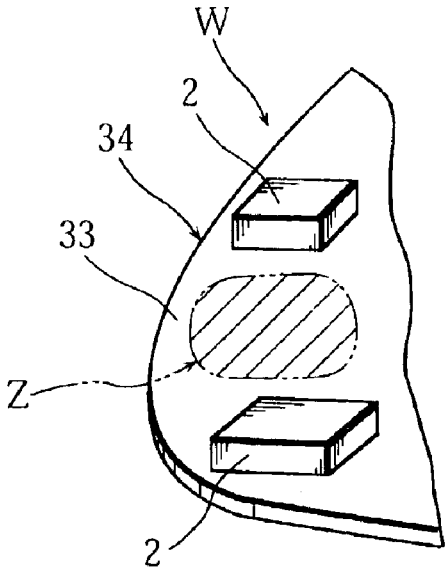
FIG. 31 is an enlarged perspective view of a principal portion.
Figure 32:
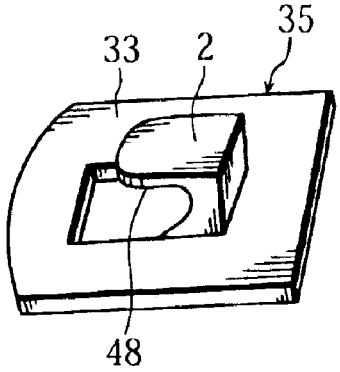
FIG. 32 is a perspective view of a principal portion.

Next, to describe attachment of the oscillation cover member 52 including the buckle female member 30 to the protector main body M on the waist portion W, first, as shown in FIG. 31, the base cover 34 is formed as to have the flat attachment area Z to which the buckle female member 30 is attached, and the attached cover 35 is formed as to have the convex portion 2 having a notched portion 48 for escapement of the buckle as shown in FIG. 14.

Figure 33:
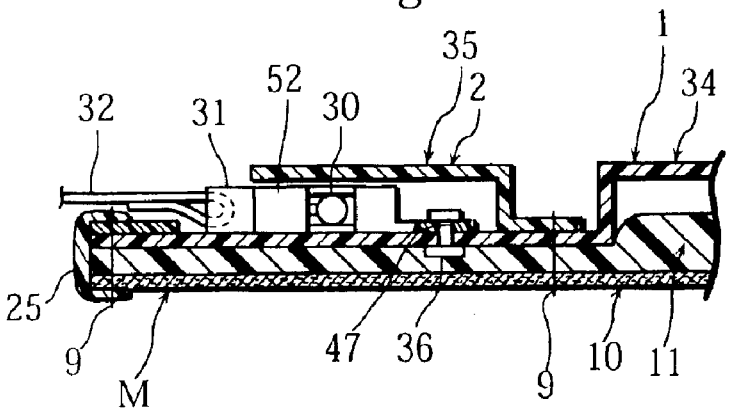
FIG. 33 is a cross-sectional view showing another embodiment of attachment state.

And, as shown in FIG. 33, the oscillation cover member 52 including the buckle female member 30 is attached on the base cover 34 with the shaft member 36, and the attached cover 35 is placed on the base cover 34 as to cover the oscillation cover member 52 with the convex portion 2 from the surface side, then, the oscillation cover member 52 is attached to the protector main body M by sewing the attached cover 35, the base cover 34, the foamed body 11, and the lining 10 as to be united with the rim-binding portion 25 and the machine sewing thread 9.

Figure 34:
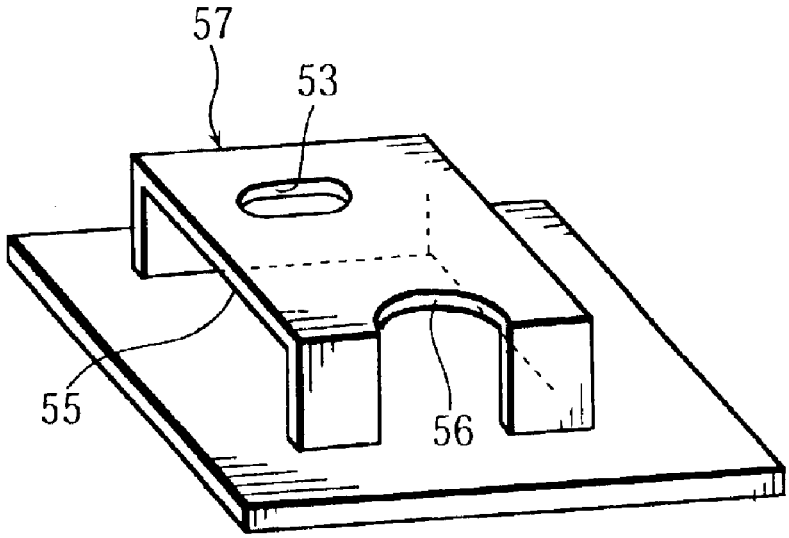
FIG. 34 is a perspective view showing a fixation cover member.
Figure 35:
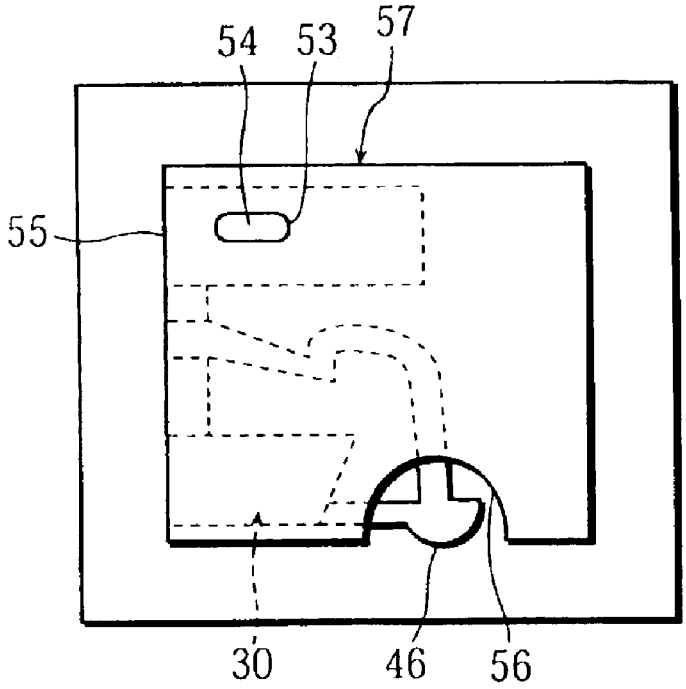
FIG. 35 is a top view.

The buckle female member 30 shown in FIG. 27 may be covered by a fixation cover member 57 shown in FIG. 34 instead of the oscillation cover member 52 above. That is to say, as shown in FIG. 34 and FIG. 35, the fixation cover member 57 is a through body in which an opening 55 for insertion of the buckle female member 30, a positioning hole 53 to which a positioning protrusion 54 of the buckle female member 30 is fitted, and a notched portion 56 to expose the pressed portion 46 of the buckle female member 30, are formed.

Figure 36:
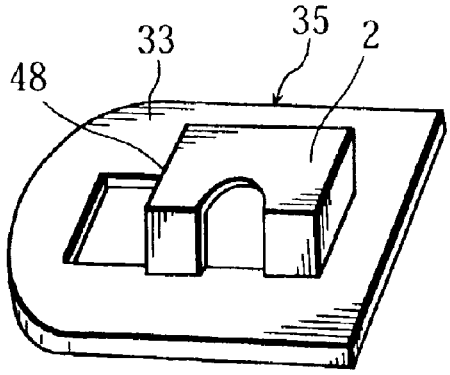
FIG. 36 is a perspective view of a principal portion.

And, to describe attachment of the fixation cover member 57 including the buckle female member 30 to the protector main body M on the waist portion W, first, as shown in FIG. 31, the base cover 34 is formed as to have the flat attachment area Z to which the buckle female member 30 is attached, and the attached cover 35 is formed as to have the convex portion 2 having a notched portion 48 for escapement of the buckle as shown in FIG. 36. The notched portion 48 of the attached cover 35 is sized only to insert the buckle male member 31 to prevent the fixation cover member 57 (the buckle female member 30) from oscillation.

Figure 37:
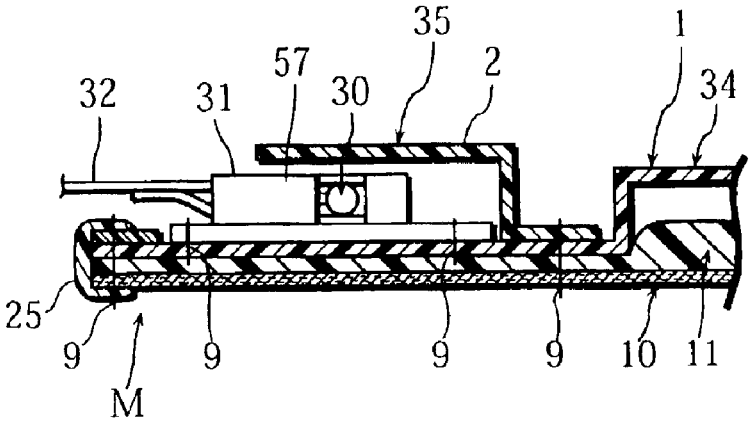
FIG. 37 is a cross-sectional view showing still another embodiment of attachment state.

And, as shown in FIG. 37, the fixation cover member 57 including the buckle female member 30 is sewn on the base cover 34 with the machine sewing thread 9, and the attached cover 35 is placed on the base cover 34 as to cover the fixation cover member 57 with the convex portion 2 from the surface side, then, the fixation cover member 57 is attached to the protector main body M by sewing the attached cover 35, the base cover 34, the foamed body 11, and the lining 10 as to be united with the rim-binding portion 25 and the machine sewing thread 9.

Figure 38:
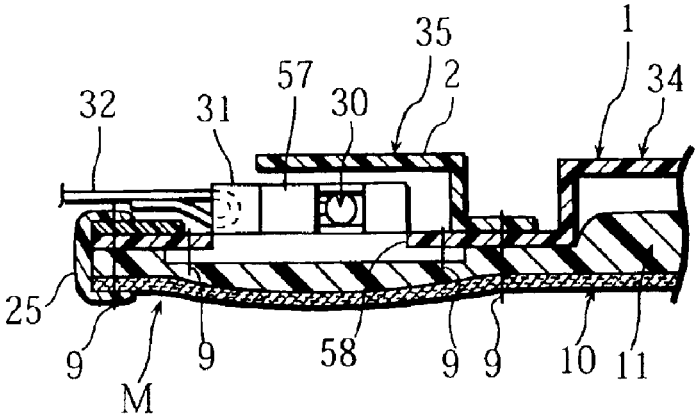
FIG. 38 is a cross-sectional view showing a further embodiment of attachment state.

As shown in FIG. 38, a window portion 58 may be formed on the base cover 34 to insert the fixation cover member 57 from the reverse side of the base cover 34 to be sewn to the base cover 34.

Figure 39:
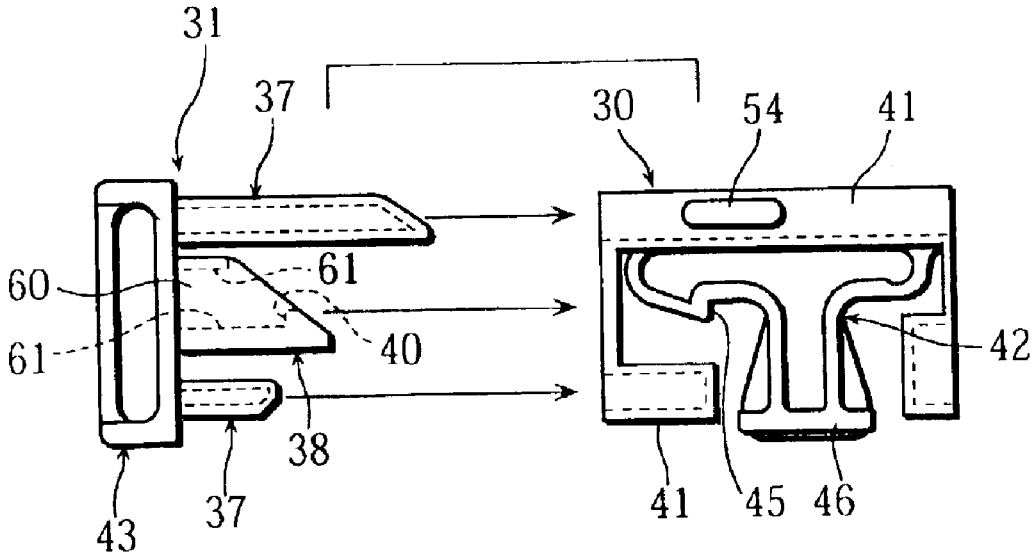
FIG. 39 is a perspective view showing still another embodiment of the buckle male and female members.

Next, FIG. 39 shows another embodiment of the buckle female member 30. The following construction is clearly different in comparison with FIG. 27. That is to say, while the buckle female member 30 in FIG. 27 bends the elastically-deformable hitching portion 42 by pushing in a direction parallel to the fixation direction of the both ends of the elastically-deformable hitching portion 42, the buckle female member 30 in FIG. 39 bends the elastically-deformable hitching portion 42 by pushing in the fixation direction of the both ends of the elastically-deformable hitching portion 42, so stress by the bend on the fixation portion of the both ends of the elastically-deformable hitching portion 42 can be reduced.

Figure 40:
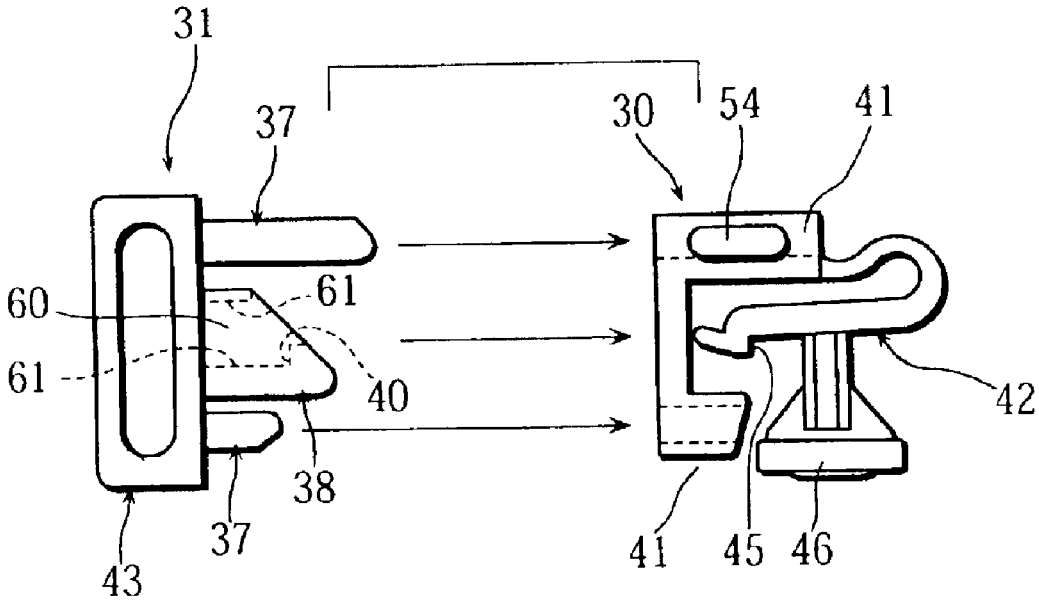
FIG. 40 is a perspective view showing a further embodiment of the buckle male and female members.

Next, FIG. 40 shows still another embodiment of the buckle female member 30. The following construction is clearly different in comparison with FIG. 39. That is to say, while the both ends of the elastically-deformable hitching portion 42 are fixed in the buckle female member 30 in FIG. 39, one end of the elastically-deformable hitching portion 42 on the hitching concave portion 45 is an free end in FIG. 40, so the elastically-deformable hitching portion 42 can be easily bent.

The surface of the cover 1 (namely, the surface wall portion 14 of the convex portion 2) may be formed preliminarily into a curved face, a concavo-convex face, or an inclined face, and the reverse side of the cover 1 may be formed as a concave curved face corresponding to the contour of the body. And, the surface of the cover may be formed preliminarily into a leather-grain pattern. In short, these configurations and patterns can be easily formed on the cover 1 by forming an injection mold into these configurations and patterns.

In the present invention, not restricted to the embodiments described above, for example, the hitching leg portion 38 of the buckle male member 31 may be cylindrical, and the design of the protector may be changed within the scope of the present invention.

According to the protector of the present invention, degree of freedom of the design of the cover 1 is enhanced to easily form desired surface configurations and patterns. And, dimensions such as the thickness of the cover 1 can be freely changed to improve shock absorbability (cushion). And, the cover 1 can be prevented from breaking by spike shoes in sliding or friction with the ground. And, the shock resistance against balls and spike shoes is improved by the convex portion 2. And, bendability (flexibility) is improved by the bending promotion portion 4 for easy deformation as to correspond to movements of the body for usefulness. And, the convex portion 2, the groove bottom 3, and the bending promotion portion 4 can be unitedly formed by injection molding for easy forming and short forming time.

Fitting feeling is given to the body because the cover easily bends along with the contour of the body to correspond to movements of both of the upper part and the lower part of the protector.

The protector is certainly sewn by the machine sewing thread 9 to be strong and excellent in durability, and bent smoothly as a whole.

Running of the machine sewing thread 9 is facilitated for certain and easy sewing.

The protector can be easily mass-produced by forming the mold into the surface configurations and patterns of the surface wall portion 14. And, various designs, hardly expected in conventional protectors, are easily made.

The cover 1 can be certainly and easily formed as to give fitting feeling to the body.

A luxurious touch can be expressed by the cover 1 of which surface appears to be made of leather or synthetic (artificial) leather.

Shock resistance is improved and the degree of freedom for designing elastic force and strength. That is to say, reaction of a ball is decreased by the elastic member 6 and bound of the fallen ball is reduced.

The player can play smoothly without strange feelings because the mask does not touch the convex portion 2 even if the player shakes his/her head during the game.

The heat of the body can be radiated to the outside to prevent the body temperature from increasing especially in hot weather in summer.

Further, new various protectors can be provided with variation of color on each part of the cover 1. And, strength of the protector is high and the durability is retained.

And, according to the protector of the present invention, the degree of freedom for designing the cover 1 is high to easily form the desired surface configurations and patterns. And, thickness of the cover 1 is freely changed to improve shock absorbability (cushion) on parts (areas) where shock absorption is especially required when the ball hits the protector. And, the cover 1 is prevented from breaking caused by sliding spike shoes. And, the shock resistance against the ball, etc. can be improved further by the convex portion 2. Therefore, the reinforced portion 22 can be principally reinforced to reduce the production cost.

The clavicle portion 23 and/or the dovetail portion 24 can be principally reinforced with the reinforced portion 22 of thermoplastic elastomer.

The belt 32 wound around the body does not cause strange feelings, and parts such as the buckle female members 30 are hardly broken without excessive bending force because the directions of the buckle female members 30 can be freely changed on the protector main body M side. And, the hitching claw portion 40 can be certainly prevented from breaking.

Further, according to the protector of the present invention, the protector can be used without strange feelings because the buckle female members 30 and the buckle male members 31 do not contact the body when the protector is put on the body. And, the buckle female members 30 and the buckle male members 31 can be prevented from breaking by stopping balls against the buckle female members 30 and the buckle male members 31. Further, the degree of freedom for design of the cover 1 is increased, and the shock resistance of the cover 1 is improved.

While preferred embodiments of the present invention have been described in this specification, it is to be understood that the invention is illustrative and not restrictive, because various changes are possible within the spirit and indispensable features.

What is claimed is:

1. A protector comprising a cover which is composed of injection-molded thermoplastic elastomer and having plural convex portions protruding from a face side, and a bending promotion portion formed on a groove bottom between neighboring convex portions, wherein the bending promotion portion is composed of a small bend convex on the face side, and the cover is freely bent to be convex to the face side.

2. A protector comprising a cover which is composed of injection-molded thermoplastic elastomer and having plural convex portions protruding from a face side, and a bending promotion portion formed on a groove bottom between neighboring convex portions, wherein the bending promotion portion is composed of a small bend convex on the face side, and the cover is freely bent to be convex to a reverse side.

3. The protector as set forth in claim 1 or claim 2, wherein two lines of machine sewing thread for sewing a lining are disposed on both sides of the small bend.

4. The protector as set forth in claim 3, wherein the bending promotion portion is partially omitted on a crossing portion of the groove bottom as to avoid the two lines of machine sewing thread.

5. A protector comprising a cover which is composed of injection-molded thermoplastic elastomer and having plural convex portions protruding from a face side, wherein the cover is made as a block construction, and neighboring divided cover pieces are layered on the groove bottom of the convex portions and connected with the lining by sewing.

6. A protector comprising a cover which is composed of injection-molded thermoplastic elastomer and having a convex portion protruding from a face side, and a buckle female member, attached to the cover as to be disposed on an inner side to a border line of a protector main body and covered by the convex portion.

7. The protector as set forth in claim 6, wherein the buckle female member is attached to the cover as to freely oscillate.

8. The protector as set forth in claim 6 or claim 7, wherein:

a buckle male member, having a hitching claw portion detachably hitching to the buckle female member, is provided with a hitching leg portion, having at least an upper wall portion and left and right side wall portions and opening toward a front end side; and the hitching claw portion is hidden inside the hitching leg portion.

9. A protector comprising a construction in which a cover is composed of injection-molded thermoplastic elastomer and having plural convex portions protruding from a face side, a buckle female member is attached to the cover as to be disposed on an inner side to a border line of a protector main body and covered by the convex portion, and a buckle male member has a hitching claw portion detachably hitching to the buckle female member and being disposed on an inner side to the border line of the protector main body in a hitching state in which the hitching claw portion is hitching to the buckle female member.

* * * * *